US012728361B2

(12) United States Patent
Whincup et al.

(10) Patent No.: US 12,728,361 B2
(45) Date of Patent: Sep. 8, 2026

(54) HYBRID PLAY SYSTEMS, SKIRTS, AND METHODS

(71) Applicant: Winx Innovations LLC, Port Charlotte, FL (US)

(72) Inventors: Robin Whincup, Port Charlotte, FL (US); Michael Robin Whincup, Bradenton, FL (US)

(73) Assignee: Winx Innovations LLC, Port Charlotte, FL (US)

( * ) Notice: Subject to any disclaimer, the term of this patent is extended or adjusted under 35 U.S.C. 154(b) by 373 days.

(21) Appl. No.: 18/508,485

(22) Filed: Nov. 14, 2023

(65) Prior Publication Data

US 2024/0157260 A1 May 16, 2024

Related U.S. Application Data

(60) Provisional application No. 63/383,540, filed on Nov. 14, 2022.

(51) Int. Cl.
*A63G 31/12* (2006.01)

(52) U.S. Cl.
CPC ..... *A63G 31/12* (2013.01)

(58) Field of Classification Search
CPC .. A63G 31/12; E04H 15/20; E04H 2015/202; E04H 2015/203; A63B 2225/62; A63B 49/11; A63H 33/008
See application file for complete search history.

(56) References Cited

U.S. PATENT DOCUMENTS 4,027,437 A * 6/1977 Monsky ..... E04H 15/20 52/2.21
5,555,679 A * 9/1996 Scherba ..... E04H 15/58 52/63
5,906,373 A * 5/1999 Sanders ..... A63B 67/00 472/134
6,565,405 B2 * 5/2003 Hsu ..... A63H 33/008 446/478
6,679,811 B2 * 1/2004 Chen ..... A63B 71/0054 482/29
7,300,354 B2 * 11/2007 Field ..... A63G 31/12 472/117
7,878,877 B2 2/2011 Scherba
9,283,419 B2 * 3/2016 Chen ..... A63B 71/022
9,797,155 B2 * 10/2017 McMahon ..... E04H 3/16
9,970,207 B2 * 5/2018 Wasson ..... E04H 15/20
(Continued)

FOREIGN PATENT DOCUMENTS

GB 2257370 A * 1/1993 ..... A63B 5/11

OTHER PUBLICATIONS

Soft Play—Classic Indoor Playground Structures; retrieved on Nov. 13, 2023; <https://www.softplay.com/products/classic-playgrounds/>.

*Primary Examiner* — Monica L Perry
(74) *Attorney, Agent, or Firm* — IPkey PLLC

(57) ABSTRACT

A hybrid inflatable park includes an inflatable park region including a plurality of inflatable attractions. The inflatable park region includes at least one inflatable chamber disposed between a play layer and a ground layer. The inflatable park region defines a well. A framed play module includes a footing forming part of a framed structure. The footing extends into the well and a skirt extends from the inflatable park region to the footing.

20 Claims, 11 Drawing Sheets

(56) References Cited

U.S. PATENT DOCUMENTS

| | | | | |
|---|---|---|---|---|
| D861,819 | S | 10/2019 | Whincup | |
| 10,702,785 | B1 * | 7/2020 | Chen | A63B 71/03 |
| D1,014,630 | S * | 2/2024 | Samson | D21/814 |
| D1,016,170 | S * | 2/2024 | Samson | D21/814 |
| D1,016,202 | S * | 2/2024 | Samson | D21/814 |
| 11,904,215 | B2 * | 2/2024 | Hayden | A63B 5/12 |
| D1,019,860 | S * | 3/2024 | Samson | D21/825 |
| D1,020,891 | S * | 4/2024 | Samson | D21/825 |
| 2007/0101466 | A1 * | 5/2007 | Ferraro | E04H 15/20 D21/835 |
| 2009/0137330 | A1 * | 5/2009 | Sefchick | A63G 31/007 472/117 |
| 2015/0148141 | A1 * | 5/2015 | Thompson | A63G 31/12 472/134 |
| 2017/0203217 | A1 * | 7/2017 | Lee | A63B 5/00 |
| 2020/0360793 | A1 * | 11/2020 | Shorma | A63B 6/00 |
| 2022/0258063 | A1 | 8/2022 | Whincup et al. | |

* cited by examiner

HYBRID PLAY SYSTEMS, SKIRTS, AND METHODS

CROSS-REFERENCE TO RELATED APPLICATIONS

This application claims the benefit of U.S. Provisional Application No. 63/383,540, filed Nov. 14, 2022, the entirety of which is incorporated by reference.

TECHNICAL FIELD

The present disclosure relates to play systems having inflatable air structures.

BACKGROUND

Inflate-a-parks and other inflatable attractions formed with inflatable air structures provide safe entertainment. For safety reasons, such inflatable attractions do not typically incorporate features with rigid framed structures (such as pad-on-frame "soft play" structures). Such features could enhance user enjoyment, yet may pose safety risks. For example, gaps between the inflatable and rigid features could pose a risk if unmitigated. Therefore, a need exists for a solution that safely integrates inflatable and rigid features in a play system.

BRIEF SUMMARY

According to an example of the present disclosure, a hybrid inflatable park is provided. The hybrid inflatable park comprises an inflatable base region comprising a plurality of inflatable attractions, wherein the inflatable base region comprises at least one inflatable chamber disposed between a play layer and a bottom layer, the inflatable base region defining a well; and a framed play module comprising a footing forming part of a framed structure. The footing extends into the well and wherein a skirt extends from the inflatable base region to the footing.

The plurality of inflatable attractions may comprise an inflatable module coupled with the framed play module. The inflatable module may extend into the framed play module. The inflatable module may extend to an elevated platform of the framed play module. The elevated platform is elevated from the play layer. A second skirt extends from an elevated portion of the inflatable module to the elevated platform.

The skirt may cover a gap in the well between the inflatable base region and the footing.

The skirt may comprise a sandwich enclosure enclosing a flap. The sandwich enclosure may comprise opposed sandwich flaps. An inward-facing fastener of the sandwich enclosure may enclose an outward-facing fastener of the flap. One of the sandwich enclosure or the flap may comprise a frame member anchor portion. One of the sandwich enclosure or the flap may extend from the inflatable base region and the other of the sandwich enclosure or the flap may extend from a frame member of the framed structure.

The plurality of inflatable attractions may be formed as a plurality of interconnected inflatable modules. A first inflatable module may define a first portion of the well and a second inflatable module may define a second portion of the well.

The well may be a first well and the footing may be a first footing. A first inflatable module defines the first well and a second inflatable module defines a second well. The first footing extends into the first well and a tower of the framed play module extends into the second well.

The well may extend through the play layer and the bottom layer of the inflatable base region.

The well may be a recess within the inflatable base region. The recess may be a blind recess. The well may be an opening extending through the inflatable base region.

A side panel connecting the play layer and the bottom layer may define the well.

According to an example of the present disclosure, a hybrid inflatable park is provided. The hybrid inflatable park comprises an inflatable base region comprising a plurality of inflatable attractions, wherein the inflatable base region comprises at least one inflatable chamber disposed between a play layer and a bottom layer, the inflatable base region defining a plurality of wells; and a framed play module comprising a plurality of footings forming part of a framed structure. Each footing of the plurality of footings extends into one well of the plurality of wells. For each footing, a skirt extends from the footing to the inflatable base region.

BRIEF DESCRIPTION OF THE SEVERAL VIEWS OF THE DRAWINGS

Non-limiting and non-exhaustive embodiments are described with reference to the following figures, wherein like reference numerals refer to like parts throughout the various views unless otherwise specified.

DETAILED DESCRIPTION

The present disclosure provides hybrid play systems having an inflatable park region integrated with at least one framed structure. Advantageously, integrating inflatable and rigid elements as taught by the present disclosure safely enhances user enjoyment. With reference to FIG. 1-FIG. 11, the present disclosure provides examples of a hybrid inflatable park 102, 302, 902 that incorporates a one or more skirts 112, 312, 812 for connecting an inflatable module with a framed structure, e.g., framed play modules 110, 310 to mitigate gaps between the inflatable module and the framed structure and promote the overall safety of the hybrid inflatable park 102, 302, 902.

Figure 1:
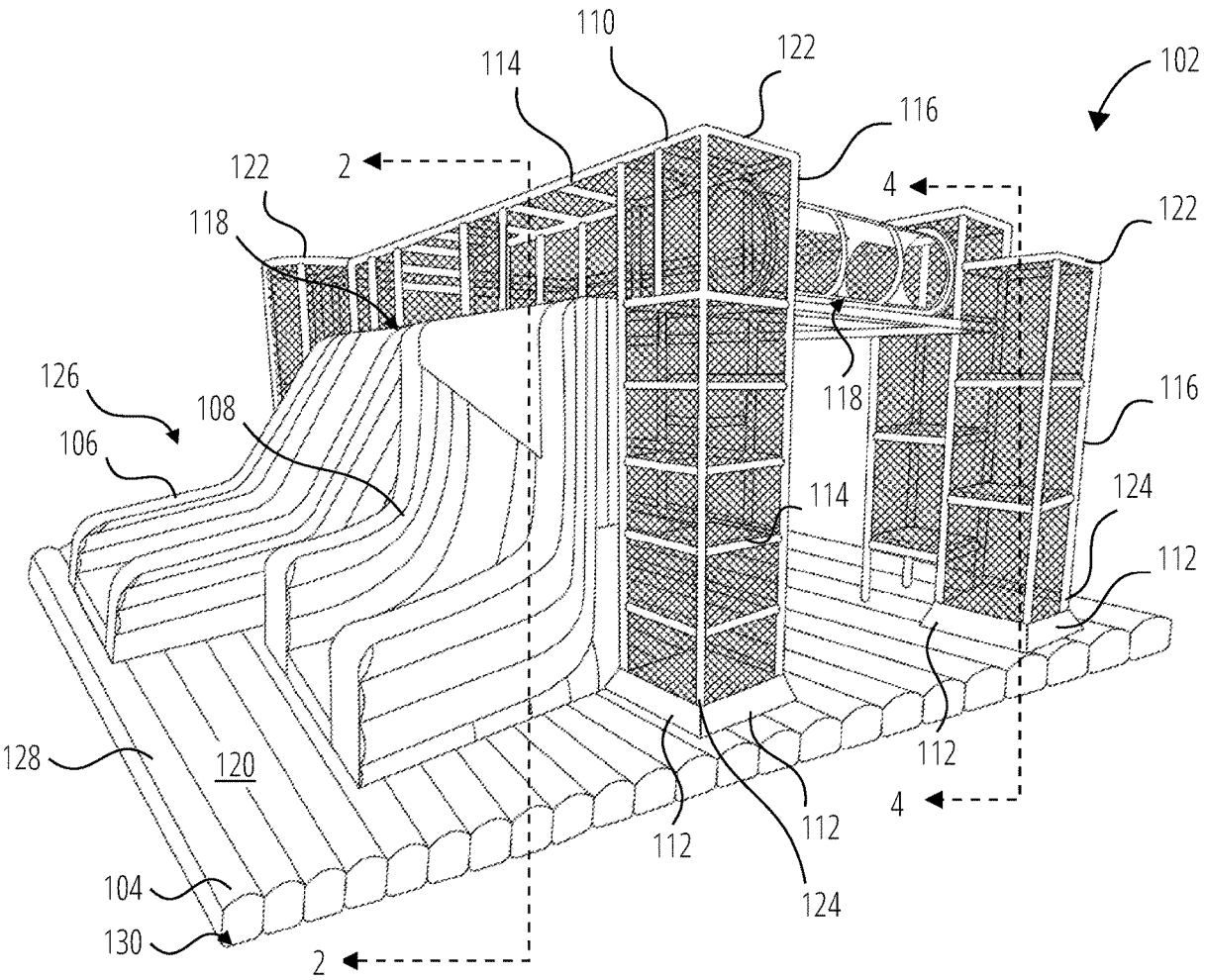
FIG. 1 illustrates a hybrid inflatable park according to an example of the present disclosure.

FIG. 1 illustrates a hybrid inflatable park 102 according to an example of the present disclosure, which may form a standalone attraction or part of a larger installation, as will be discussed in further detail below. The hybrid inflatable park 102 is a hybrid structure because it safely integrates both inflatable and rigid-frame elements. In particular, the hybrid inflatable park 102 includes at least one inflatable attraction integrated with at least one framed play module.

According to the example of FIG. 1, the hybrid inflatable park 102 includes an inflatable park region 104 incorporating at least one inflatable attraction 126 comprising at least one inflatable module, e.g., inflatable modules 106, 108. Each inflatable module 106, 108 may be integrally formed with the inflatable park region 104. For instance, as shown in FIG. 1, the inflatable park region 104 comprises the first inflatable module 106, e.g., an inflatable slide. The inflatable park region 104 further comprises the second inflatable module 108, e.g., an inflatable climbing wall, warped wall or ninja wall. As is also shown in FIG. 1, the inflatable park region 104 includes a base inflatable portion 128 that defines a play layer 120 (i.e., an upper most surface on which users walk, run, and bounce) and an opposing ground layer 130 (i.e., a ground facing layer). In any embodiment, the base inflatable portion 128 may be an integral portion of any of the inflatable attractions, e.g., formed integrally with inflatable module 106 and/or inflatable module 108.

The inflatable park region 104, and particularly each inflatable module 106, 108 generally comprises one or more one or more inflatable air structures, chambers, bladders, pockets, or the like formed between the play layer 120 and the ground layer 130 and constructed from a flexible material (e.g., vinyl, rubber, textile, or similar material), which may be inflated to an operating pressure (e.g., 50-100 psi, or otherwise greater than atmospheric pressure) with air or other gases, such as from a blower, air compressor, or other pneumatic source. Representative inflatable air structures are taught by U.S. Patent Publication No. US2022/0258063 A1, which is hereby incorporated by reference in its entirety. The compliant nature of such inflatable air structures increases the safety and fun of play systems. The present disclosure refers to inflatable attractions and inflatable chambers as representative inflatable air structures; however, this is representative and not limiting. The hybrid play systems, skirts, and methods of the present disclosure may include any inflatable air structure.

The framed play module 110 generally includes a frame formed from a plurality of interconnected frame members, e.g., horizontal frame members 114 and vertical frame members 116. The frame members 114, 116 are generally formed from sections of steel pipe, structural sections, or similar sections of rigid material. The frame members 114, 116 are joined together to form frames for one or more towers 122 and elevated platforms 118. The elevated platforms 118 are located above the play layer 120 and provide for elevated access to the upper portions of the towers 122 and, according to an example, to the inflatable modules 106, 108, as will be discussed below. To that end, the framed structure in an elevated platform 118 may include openings therein to allow for users to move between the inflatable modules 106, 108 and the elevated platform 118.

The framed play module 110 may incorporate additional framed structures, such as staircases, walkways, tunnels, and the like. Accordingly, the framed play module 110 may incorporate one or more intermediate structures, such as standing platforms formed of plywood to enable access and safe use of the framed play module 110. To enhance safety, any of the frame members 114, 116 may bear polymer and/or inflatable padding. It is to be appreciated that the present disclosure is relevant to all rigid frame play modules and is not limited to the representative framed play modules 110, 310 shown in the drawings and described herein.

As shown in FIG. 1 the framed play module 110 includes one or more vertically extending towers 122 comprised of horizontal frame members 114 and vertical frame members 116. Each tower 122 includes a footing 124 that extends into a respective well 134, shown in FIG. 4A and FIG. 4B, formed in the inflatable park region 104 to allow the footing 124 to engage and be appropriately fastened to a floor or other base structural support for the hybrid inflatable park 102. One or more skirts 112 extend between the inflatable park region 104 and the footing 124 of each of the towers 122 so as to connect the base inflatable portion 128 to the footing 124 of each tower 122, as will be discussed in further detail below. As shown in FIG. 1, the framed play module 110 includes a plurality of towers 122. Accordingly, the inflatable park region 104 will define a plurality of wells 134 therein for receiving the footings 124 of the towers 122, such that each footing 124 extends into one well 134, as is discussed in further detail below with reference to FIG. 10 and FIG. 11.

It shall be appreciated that the framed play module 110 may include one or more footings that do not form part of a tower, e.g., extend from a non-tower structure such as a horizontal frame member.

Figure 2:
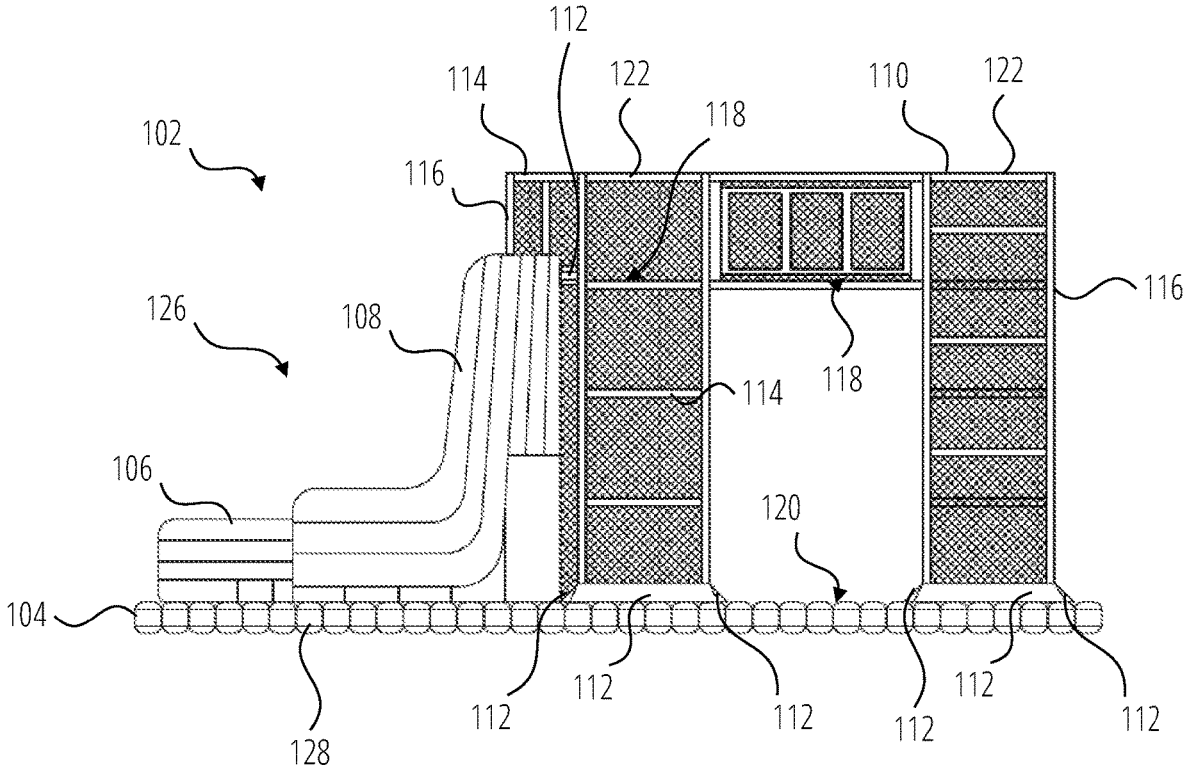
FIG. 2 illustrates a cross-sectional view of the hybrid inflatable park of FIG. 1 taken along lines 2-2 shown in FIG. 1.

FIG. 2 illustrates a cross-sectional view of the hybrid inflatable park 102 taken along lines 2-2 shown in FIG. 1, according to an example of the present disclosure. As shown in FIG. 2, a skirt 112 also extends between an elevated platform 118 forming part of the framed play module 110 and one of or both of the inflatable modules 106, 108 that extend to the elevated platform 118. The skirt 112 connects the inflatable module(s) 106, 108 to the elevated platform 118 and closes any gap or spacing that may occur between the inflatable module 106, 108 and the elevated platform 118.

FIG. 2 further illustrates multiple skirts 112 extending between the base inflatable portion 128 and different sides of each of the towers 122. According to an example, skirts 112 connect the base inflatable portion 128 to each side of each tower 122.

Figure 3:
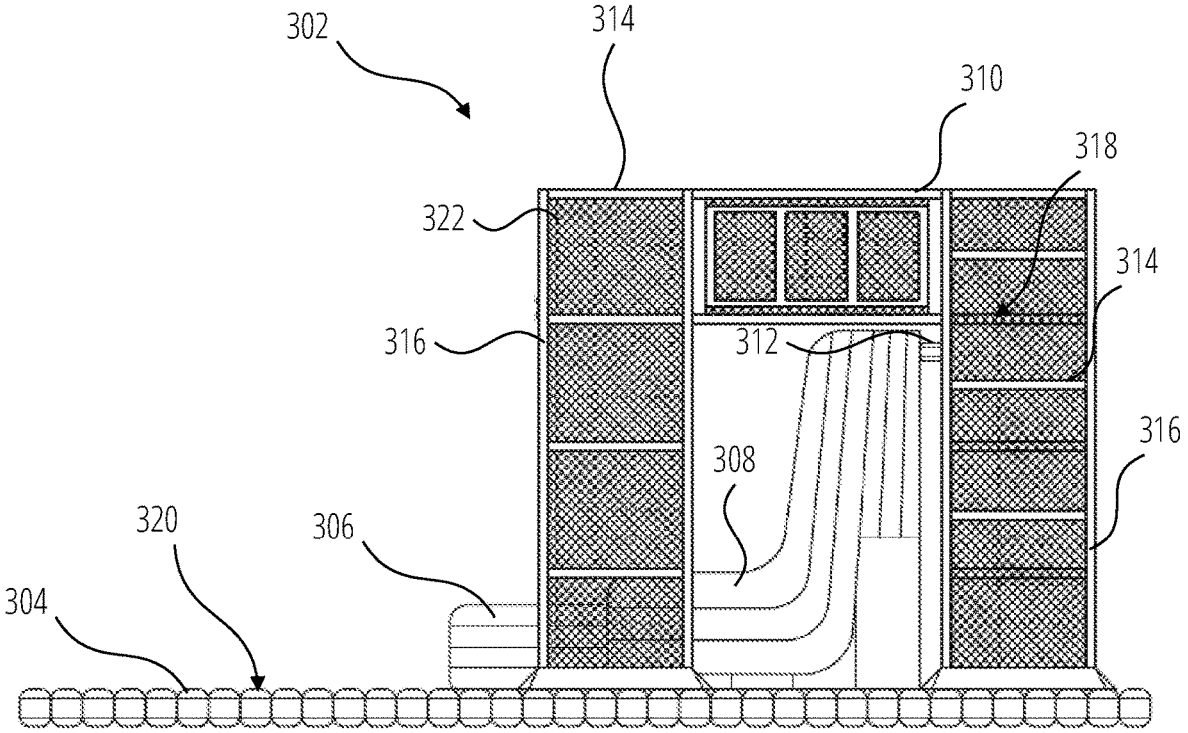
FIG. 3 illustrates a side view of a hybrid inflatable park according to an example of the present disclosure.

FIG. 3 illustrates a side view of a hybrid inflatable park 302 according to another example of the present disclosure. The hybrid inflatable park 302 includes an inflatable park region 304 comprised of inflatable modules 306, 308 formed integrally therewith and defining a play layer 320, as discussed above with respect to the example of FIG. 1. The hybrid inflatable park 302 also includes a framed play module 310 comprised horizontal frame members 314 and vertical frame members 316 arranged to form one or more elevated platforms 318 and one or more towers 322, as is also discussed above with respect to the example of FIG. 1.

According to the example of FIG. 3, the inflatable modules 306, 308 extend into and through a central portion of the framed play module 310 such that one or more towers 322 extend upwardly alongside the inflatable modules 306, 308 and the framed play module 310 surrounds the inflatable modules 306, 308. A skirt 312 extends between elevated platform 318 of the framed play module 310 and one or more of the inflatable modules 306, 308 to connect the inflatable modules 306, 308 to the elevated platform 318, as also discussed above with respect to the example of FIG. 1 and FIG. 2.

According to the example, positioning the inflatable modules 306, 308 within the perimeter of the framed play module 310, rather than on the perimeter as in the example of FIG. 1 and FIG. 2, serves to expand the play options while using the hybrid inflatable parks 302.

Figure 4A:
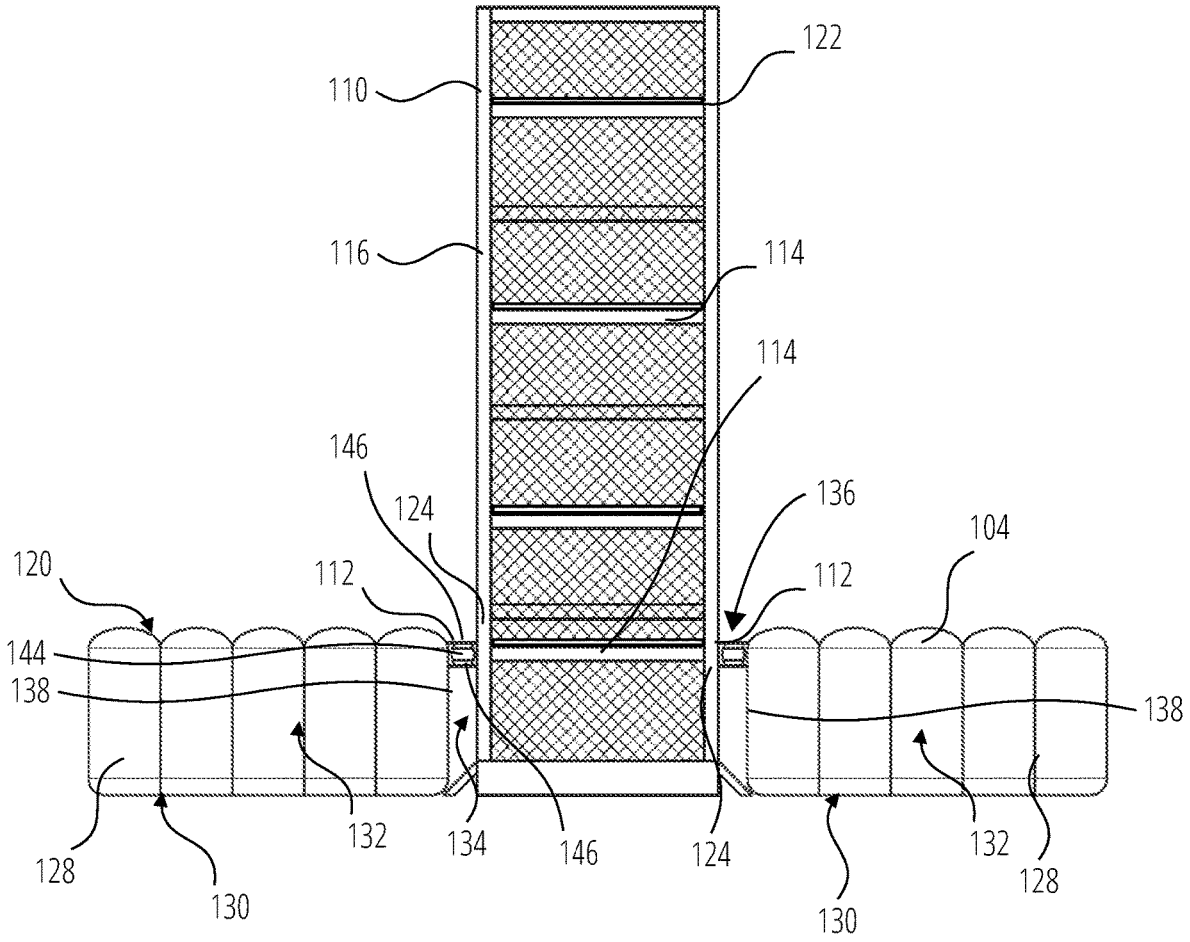
FIG. 4A illustrates a cross-sectional view of the hybrid inflatable park of FIG. 1 taken along lines 4-4 shown in FIG. 1.

FIG. 4A, illustrates a cross-sectional view of the hybrid inflatable park 102 taken along lines 4-4 shown in FIG. 1, according to an example of the present disclosure. As shown in FIG. 4A, the inflatable park region 104 includes the base inflatable portion 128, which defines the top play layer 120 and a ground layer 130 and one or more inflatable chambers 132 extending between the play layer 120 and the ground layer 130. The base inflatable portion 128 also defines a well 134 that receives the footing 124 of a tower 122 of the framed play module 110 extending into the well 134 to the floor or other support structure, as discussed above. One or more skirts 112 extend from the base inflatable portion 128 to the footing 124 and connect the base inflatable portion 128 to the footing 124 of the tower 122.

As shown in FIG. 4A, the well 134 may comprise an opening that extends through both the play layer 120 and the ground layer 130 of the base inflatable portion 128. In some embodiments, the base inflatable portion 128 may include a number of side panels 138 connecting the play layer 120 and the ground layer 130, which serve to define the well 134.

The opening of the well 134 may have a shape which is complementary to the shape of the footing 124 of the tower 122 of the framed play module 110 as it extends into and through the well 134. As shown, and with additional reference to FIG. 1, FIG. 10, and FIG. 11, the well 134 has a rectangular shape sized to receive the rectangular footing 124 of the tower 122. According to an example, the well 134 may be generally sized such that footing 124 forms a close or snug fit with the opening of the well 134 to minimize the size of any gaps 136 extending between the base inflatable portion 128 and the footing 124. It is to be appreciated that size the gap 136 illustrated in FIG. 4A may be exaggerated in comparison to the relative sizes of the illustrated base inflatable portion 128 and footing 124 for the purpose of more clearly illustrating the features of the present disclosure.

However, despite the close integration of the footing 124 of the framed play module 110 and the base inflatable portion 128 of the inflatable park region 104, the gap 136 shown in FIG. 4A may persist between the two around the perimeter of the opening of the well 134. As shown in FIG. 1 and FIG. 4A, the one or more skirts 112 extending between the base inflatable portion 128 and the footing 124 additionally serve to cover the gap 136 in the well 134 between the base inflatable portion 128 and the footing 124 in order to mitigate the possibility of a user accidentally catching a hand, arm, foot, leg, or other body part within the gap 136 and to promote the overall safety of the hybrid inflatable park 102.

Figure 4B:
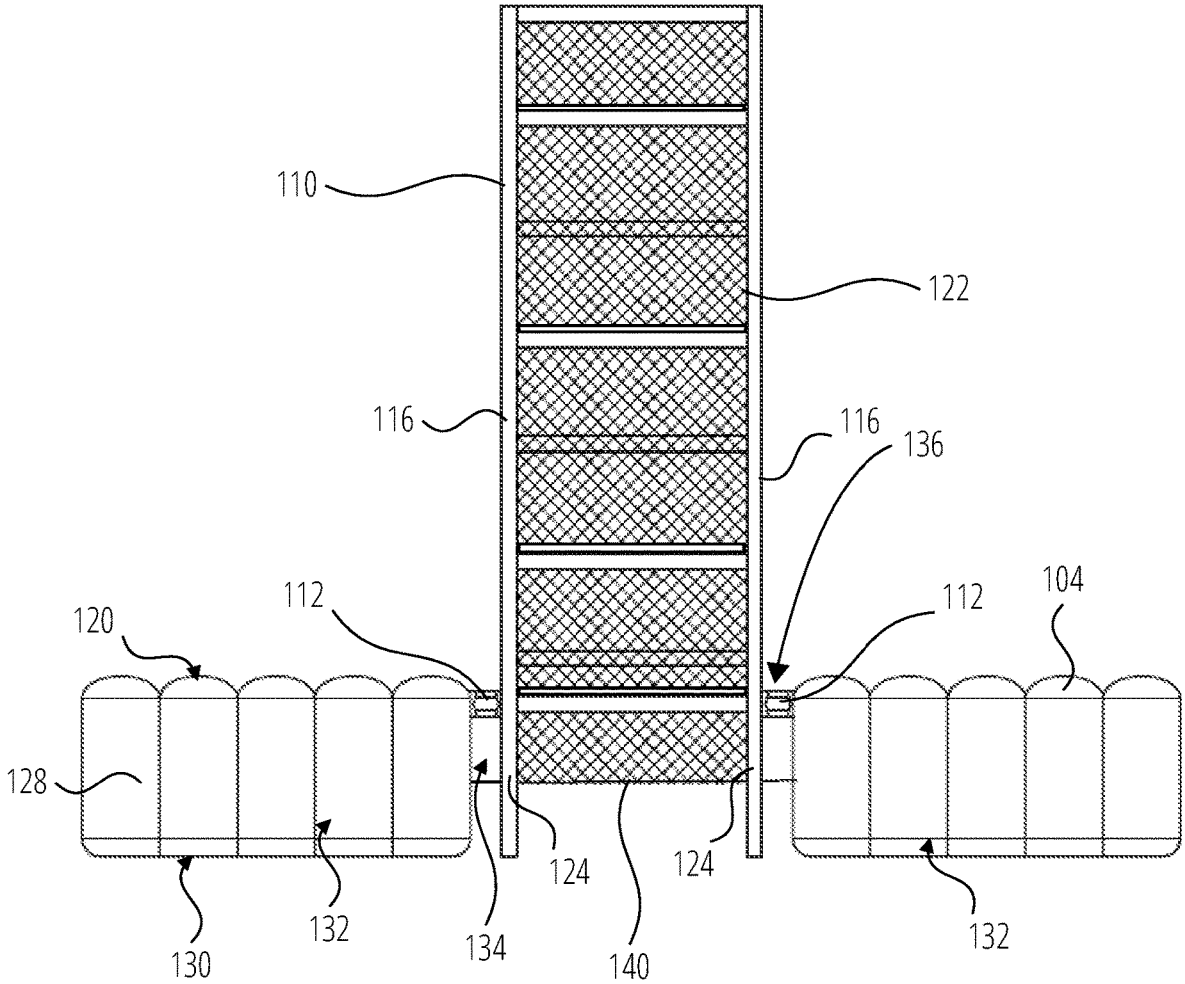
FIG. 4B illustrates another cross-sectional view of the hybrid inflatable park of FIG. 1 taken along lines 4-4 shown in FIG. 1 according to an example.

FIG. 4B illustrates another cross-sectional view of the hybrid inflatable park 102 taken along lines 4-4 shown in FIG. 1, according to an example of the present disclosure. As shown in FIG. 4A, the inflatable park region 104 includes the base inflatable portion 128, which defines the top play layer 120 and a ground layer 130 and one or more inflatable chambers 132 extending between the play layer 120 and the ground layer 130. The base inflatable portion 128 also defines a well 134 that receives the footing 124 of a tower 122 of the framed play module 110 extending into the well 134 to the floor or other support structure, as discussed above. One or more skirts 112 extend from the base inflatable portion 128 to the footing 124 and connect the base inflatable portion 128 to the footing 124 of the tower 122.

As shown in FIG. 4B, the well 134 may comprise a recess within the base inflatable portion 128. According to a particular example, the well 134 may comprise a blind recess defining a recess bottom 140 defined in the base inflatable portion 128 part way between the play layer 120 and the ground layer 130. The recess bottom 140 may have smaller openings defined therein to permit the individual vertical frame members 116 forming the footing 124 to pass through the base inflatable portion 128 to the floor or support structure.

Figure 5:
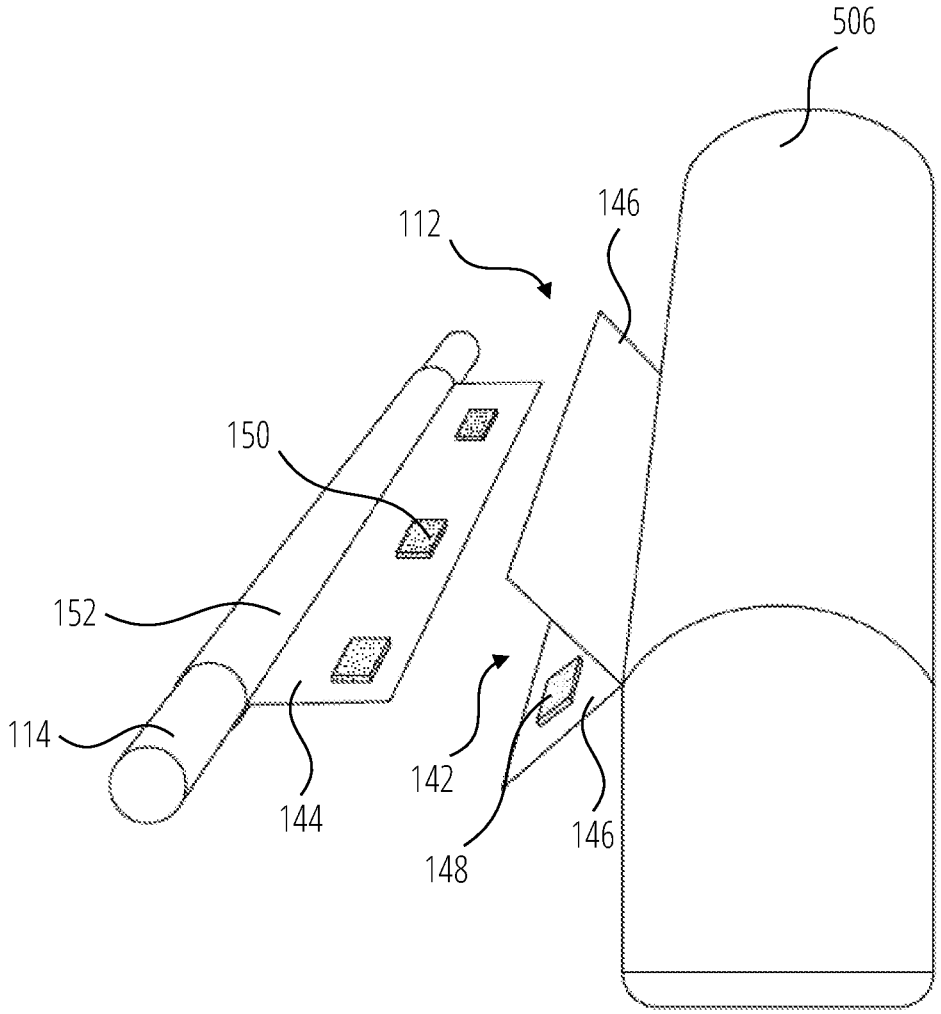
FIG. 5 illustrates a representative schematic of a skirt, frame member, and inflatable module according to an example of the present disclosure.

FIG. 5 illustrates a representative schematic of a skirt 112, horizontal frame member 114, and inflatable module 506 according to an example of the present disclosure. It is to be appreciated that the structure of the skirt 112 illustrated in FIG. 5 is applicable to the skirts 112, 312 discussed above with respect to FIG. 1-FIG. 4B. It is also to be appreciated that the horizontal frame member 114 is representative of any one of the horizontal frame members 114, 314 of the frame framed play modules 110, 310 discussed above and the inflatable module 506 illustrated in FIG. 5 is representative of any one of the inflatable modules 106, 108, 306, 308 or base inflatable portions 128 discussed above. Accordingly, the skirt 112 illustrated in FIG. 5 is configured to both connect the horizontal frame member 114 to the inflatable module 506 and to cover any gap extending between the horizontal frame member 114 and the inflatable module 506.

As shown in FIG. 5, the skirt 112 includes a sandwich enclosure 142 that encloses a flap 144. According to a particular example, the sandwich enclosure 142 includes opposed sandwich flaps 146 located on a common surface, such as an outer surface of the inflatable module 506 or the horizontal frame member 114. Each of the sandwich flaps 146 comprises a length of material (such as vinyl or nylon), which may have a length corresponding to a length of the associated horizontal frame member 114. The sandwich flaps 146 may be anchored to the inflatable module 506 or the horizontal frame member 114, such as with stitches.

As is also shown in FIG. 5, the flap 144 includes a frame member anchor portion 152 for connecting the flap 144 to the horizontal frame member 114. The frame member anchor portion 152 includes a section configured to couple with the horizontal frame member 114. In some examples, the frame member anchor portion 152 is a length of material that wraps around the horizontal frame member 114 and is fastened thereto, such as by stitching, fasteners, or the like. In some examples, the frame member anchor portion 152 includes a rigid length of substantially rigid material (e.g., PVC, ABS, spring steel, or similar) having a semicircular profile sized to snap onto the horizontal frame member 114. The flap 144 comprises a length of material (such as vinyl or nylon), which may have a length corresponding to the associated frame member anchor portion 152 and/or the horizontal frame member 114. The flap 144 is attached to the frame member anchor portion 152, such as with an adhesive, stitching, or a fastener.

It is to be appreciated that the positions of the flap 144 and the sandwich enclosure 142 may be reversed. According to such an example, the sandwich flaps 146 of the sandwich enclosure 142 may extend from the horizontal frame member 114 and be anchored to the horizontal frame member 114 by the frame member anchor portion 152 and the flap 144 may extend from and be anchored to the inflatable module 506.

As shown in FIG. 5, each of the sandwich flaps 146 includes at least one reversible, inward facing fastener 148, such as a patch of hook-and-loop fastening material (shown in FIG. 5), a rivet, a snap, or a similar mechanical fastener. According to an example, the sandwich enclosure 142 comprises a plurality of inward facing fasteners 148 spaced along both of the sandwich flaps 146. The flap 144 comprises a corresponding number of reversible, outward facing fasteners 150 on the outward facing surfaces of the flap 144 that are configured to couple with the inward facing fasteners 148 of the sandwich enclosure 142. Accordingly, the inward facing fasteners 148 of the sandwich enclosure 142 fasten to the outward facing fasteners 150 of the flap 144, thereby enclosing (or "sandwiching") the flap 144 between the sandwich flaps 146. According to another example, the inward facing fastener 148 and the outward facing fastener 150 each comprise a single strip of hook and loop fastener material that extends along the entire or substantially the entire length of the respective sandwich flaps 146 and the flap 144.

With reference to FIG. 4A and FIG. 5, in use, the sandwich flaps sandwich flap 146 and the flap 144 extend toward each other, and the sandwich flaps 146 securely enclose the flap 144 therebetween with the aid of the fasteners 148, 150 disposed on the interfacing surfaces. In manner, the skirt 112, 312 securely covers any gap persisting between the framed play module 110, 310 and the various inflatable modules 106, 108, 128, 306, 308, 506 that may be connected to or associated with the framed play module 110, 310. Accordingly, as shown in FIG. 1-FIG. 4B, the hybrid inflatable park 102, 302 may include a plurality of skirts 112, 312, each sized for covering different gaps formed in the hybrid inflatable park 102, 302.

It is to be appreciated that the skirts 112, 312 described herein may be implemented in any dimension appropriate for the installation of the hybrid inflatable park 102, 302, may be provided as separate stand-alone apparatus attachable to the inflatable modules 106, 108, 128, 306, 308, 506 and the framed play module 110, 310, and/or may be provided as elements at least partially formed integrally with the inflatable modules 106, 108, 128, 306, 308, 506.

Figure 6A:
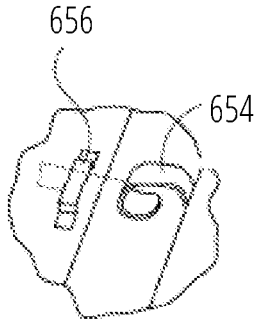
FIG. 6A illustrates a view of a fastening mechanism in an unfastened state according to an example.

FIG. 6A illustrates a clasp fastening mechanism that may be used in connection with the skirt 112 discussed above with reference to FIG. 5, according to an alternative example. As shown in FIG. 6A, the clasp mechanism is in an unfastened state. The clasp mechanism includes a hook 654 disposed on either one of the sandwich flaps 146 or the flap 144 and a corresponding eye 656 disposed on the other of the sandwich flaps 146 or the flap 144.

Figure 6B:
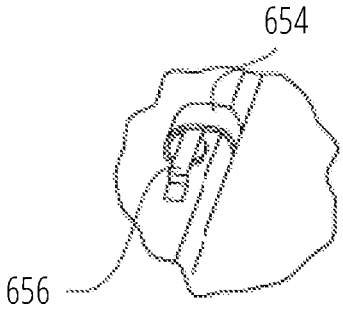
FIG. 6B illustrates a view of the fastening mechanism of FIG. 6A in a fastened state.

FIG. 6B illustrates the hook 654 and the eye 656 of the clasp mechanism shown in FIG. 6A in a fastened state.

Figure 7A:
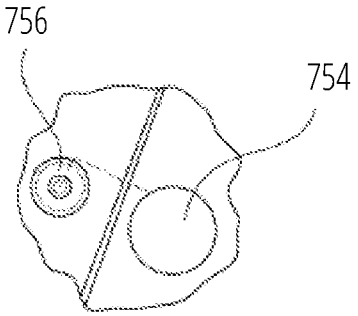
FIG. 7A illustrates a view of another fastening mechanism in an unfastened state according to an example.

FIG. 7A illustrates a snap fastening mechanism that may be used in connection with the skirt 112 discussed above with reference to FIG. 5, according to an alternative example. As shown in FIG. 7A, the snap mechanism is in an unfastened state. The snap mechanism includes a male snap 756 disposed on either one of the sandwich flaps 146 or the flap 144 and a corresponding female snap 754 disposed on the other of the sandwich flaps 146 or the flap 144.

Figure 7B:
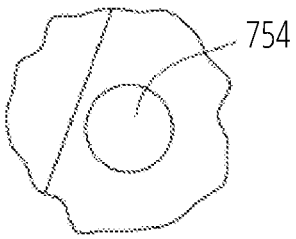
FIG. 7B illustrates a view of the fastening mechanism of FIG. 7A in a fastened state.

FIG. 7B illustrates the snap mechanism shown in FIG. 7A in a fastened state.

Figure 8:
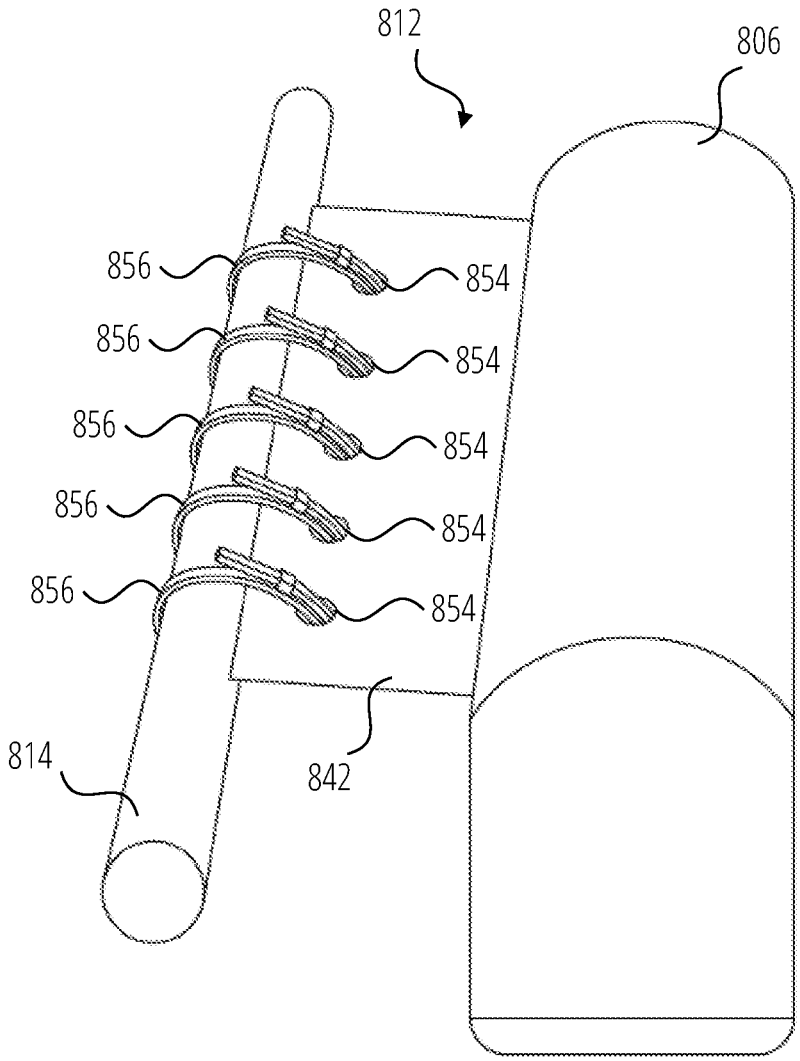
FIG. 8 illustrates a representative schematic of a skirt, frame member, and inflatable module according to an example.

FIG. 8 illustrates a representative schematic of a skirt 812, horizontal frame member 814, and inflatable module 806 according to an alternative example of the present disclosure. It is to be appreciated that the structure of the skirt 812 illustrated in FIG. 8 is applicable to the skirts 112, 312 discussed above with respect to FIG. 1-FIG. 4B. It is also to be appreciated that the horizontal frame member 814 is representative of any one of the horizontal frame members 114, 314 of the frame framed play modules 110, 310 discussed above and the inflatable module 806 illustrated in FIG. 8 is representative of any one of the inflatable modules 106, 108, 128, 306, 308 discussed above. Accordingly, the skirt 812 illustrated in FIG. 8 is configured to both connect the horizontal frame member 814 to the inflatable module 806 and to cover any gap extending between the horizontal frame member 814 and the inflatable module 806.

As shown in FIG. 8, the skirt 812 includes a flap 842 comprising a length of material (such as vinyl or nylon), which may have a length corresponding to a length of the associated horizontal frame member 814. According to the example, the flap 842 extends from and is anchored to the inflatable module 806, such as with stitches. The flap 842 comprises a plurality of grommet holes 854, i.e., holes extending through the material of the flap 842 that are formed and reinforced by suitable grommet rings. A plurality of tie downs 856 extend through the grommet holes 854 and wrap around the horizontal frame member 814 to connect the inflatable module 806 to the horizontal frame member 814 and close any gap extending between the horizontal frame member 814 and the inflatable module 806, as discussed above. According to a particular example, each tie down 856 comprises a zip tie device associated with a respective grommet hole 854 in the flap 842.

It is to be appreciated that the tie downs 856 shown in FIG. 8 may be replaced with at least one tie down of a different type than shown. For instance, the at least one tie down may comprise one or more lengths of rope or one or more elastic cords passed through multiple grommet holes 854 in the flap 842 and wrapped around the horizontal frame member 814, such as in the manner of a lashing, to connect the flap 842 to the horizontal frame member 814.

Figure 9:
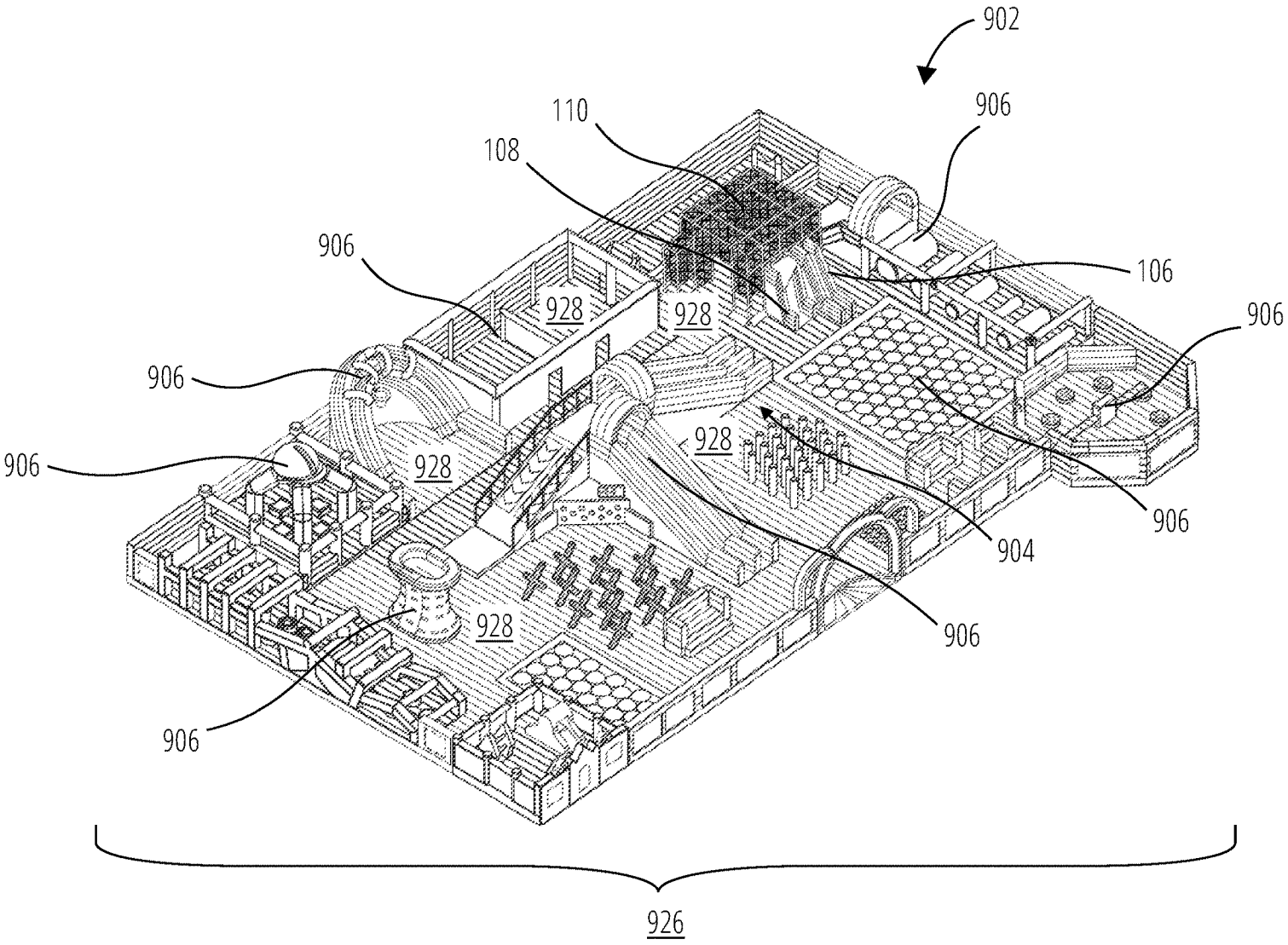
FIG. 9 illustrates a hybrid inflatable park according to another example of the present disclosure.

FIG. 9 illustrates a hybrid inflatable park 902 according to another example of the present disclosure. The hybrid inflatable park 902 includes an inflatable park region 904 that comprises plurality of inflatable attractions 926. The plurality of inflatable attractions 926 is formed as a number of interconnected base inflatable portions 928 and inflatable modules 906 that serve as play elements and/or obstacles within the hybrid inflatable park 902.

As shown in FIG. 9, the hybrid inflatable park 902 also includes a framed play module 110, as discussed above with reference to FIG. 1, associated with one or more of the base inflatable portions 928. As also discussed above with reference to FIG. 1, one or more inflatable modules 106, 108 may extend to or into the framed play module 110 and be accessible from one or more elevated platforms of the framed play module 110. Accordingly, FIG. 9 demonstrates that it is possible to integrate the framed play module 110 and associated inflatable modules 106, 108 within a larger and more extensive hybrid inflatable park 902 that includes a plurality of inflatable modules 906, 928 not directly associated with the framed play module 110.

It is to be appreciated that the hybrid inflatable park 902 additionally includes a plurality of skirts 112, 312, 812, as discussed above with reference to FIG. 1-FIG. 8, for integrating the framed play module 110 with the inflatable park region 904 and the inflatable modules 106, 108, 928.

Figure 10:
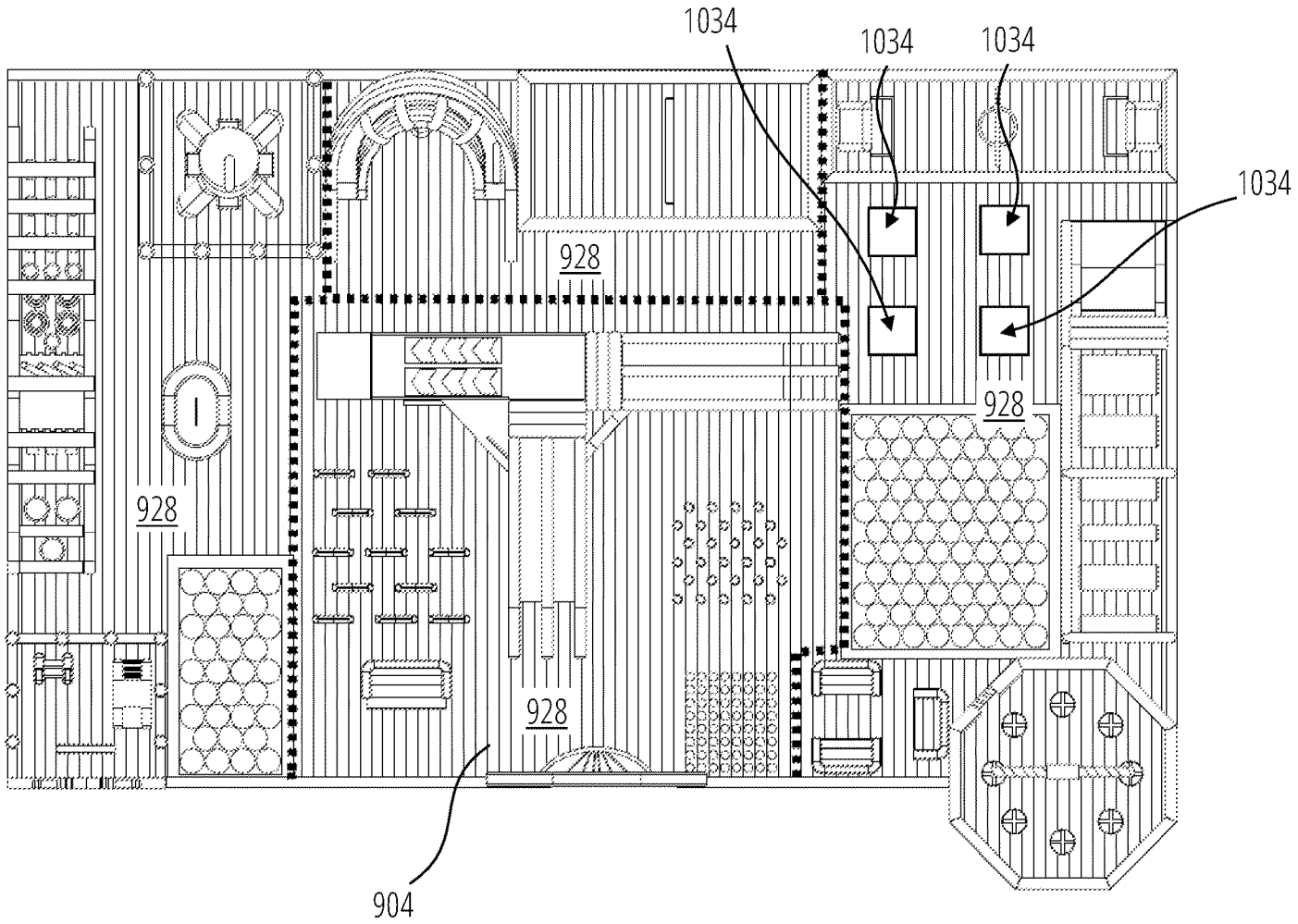
FIG. 10 illustrates a top schematic of the hybrid inflatable park of FIG. 9.

FIG. 10 illustrates a top schematic of the hybrid inflatable park 902 shown in FIG. 9 according to an example of the present disclosure. The dotted lines shown in FIG. 10 represent the boundaries between the base inflatable portions 928 of the hybrid inflatable park 902.

FIG. 10 illustrates the hybrid inflatable park 902 with the framed play module 110 removed to expose the one or more wells 1034 for receiving the footings of the framed play module 110, as discussed in detail above with reference to FIG. 1-FIG. 4B, for purposes of illustration. According to an example, the wells 1034 shown in FIG. 10 have the same or a similar structure to the wells 134 discussed above with reference to FIG. 4A or FIG. 4B. According to the example of FIG. 10, all of the wells 1034 associated with the framed play module 110 are formed within a single base inflatable portion 928. It is to be appreciated that each of the wells 1034 illustrated in FIG. 10 has one or more associated skirts 112, 312, 812 for connecting the footings of the framed play module 110 to the base inflatable portion 928 and covering any gaps over the wells 1034.

Figure 11:
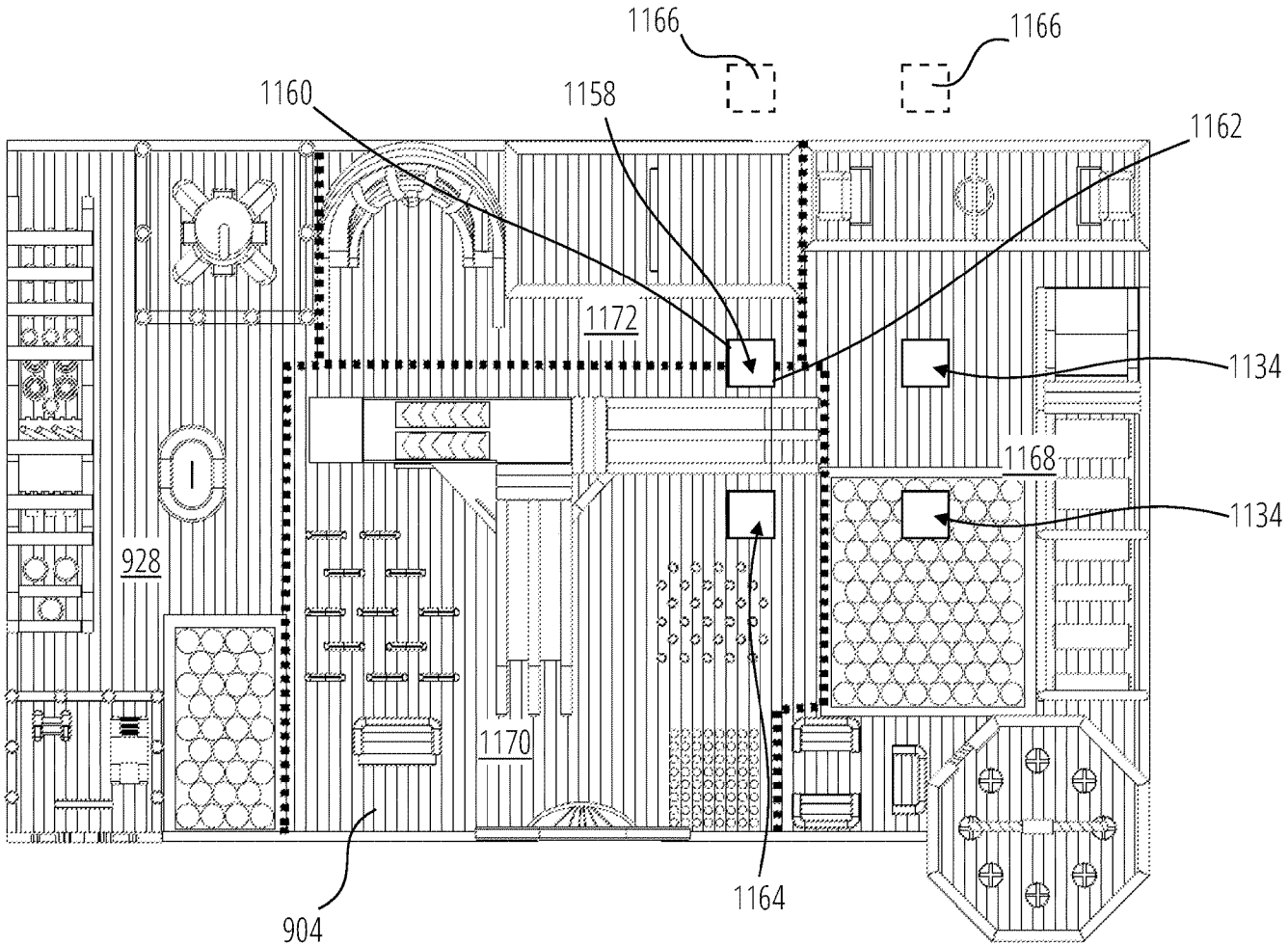
FIG. 11 illustrates a another top schematic of the hybrid inflatable park of FIG. 9 according to an example.

FIG. 11 illustrates a top schematic of the hybrid inflatable park 902 shown in FIG. 9 according to another example of the present disclosure. The dotted lines in FIG. 11 represent the boundaries between the base inflatable portions 928, 1168, 1170, 1172 of the hybrid inflatable park 902.

FIG. 11 illustrates the hybrid inflatable park 902 with the framed play module 110 removed to expose the one or more wells 1134, 1158, 1164 for receiving the footings of the framed play module 110, as discussed in detail above with reference to FIG. 1-FIG. 4B, for purposes of illustration. According to an example, the wells 1134, 1158, 1164 shown in FIG. 11 have the same or a similar structure to the wells 134 discussed above with reference to FIG. 4A or FIG. 4B.

According to the example of FIG. 11, the hybrid inflatable park 902 may be configured so that the framed play module 110 straddles multiple base inflatable portions 1168, 1170, 1172. Accordingly, the hybrid inflatable park 902 may include one or more wells 1134 defined in one base inflatable portion 1168 and one or more wells 1164 defined in a different base inflatable portion 1170. As shown in FIG. 11, the hybrid inflatable park 902 may also include one or more wells 1158 formed between different base inflatable portions 1170, 1172 such that one base inflatable portion 1172 defines a first portion 1160 of the well 1158 and a different base inflatable portion 1170 defines a second portion 1162 of the well 1158.

It is to be appreciated that each of the wells 1158, 1134, 1164 illustrated in FIG. 11 has one or more associated skirts 112, 312, 812 for connecting the footings of the framed play module 110 to the base inflatable portions 1168, 1170, 1172 and covering any gaps over the wells 1158, 1134, 1164.

According to another example illustrated in FIG. 11, the framed play module 110 may also straddle the outer boundary of the hybrid inflatable park 902 such that portions of the framed play module 110 extend outside of the inflatable park region 904 of the hybrid inflatable park 902 and footings or similar structures of the framed play module 110 are attached at anchor points 1166 outside of the inflatable park region 904. The anchor points 1166 may be formed directly on an exposed floor or support structure surrounding the hybrid inflatable park 902 or on a nearby wall or other standing structure.

As used herein, the singular forms of "a", "an", and "the" include plural referents unless the context clearly states otherwise. Also, in this regard, the present application may use the term "plurality" to reference a quantity or number. In this regard, the term "plurality" is meant to be any number that is more than one, for example, two, three, four, five, etc. The terms "about," "approximately," "near," etc., mean plus or minus 5% of the stated value. For the purposes of the present disclosure, the phrases "at least one of A, B, and C," "at least one of A, B, or C," or similar expressions referencing two or more elements includes: (A), (B), (C), (A and B), (A and C), (B and C), or (A, B, and C), including all further possible permutations when greater than three elements are listed.

As used herein, the terms "right", "left", "top", and derivatives thereof shall relate to the invention as it is oriented in the drawing figures. However, it is to be understood that the invention can assume various alternative orientations and, accordingly, such terms are not to be considered as limiting. Also, it is to be understood that the invention can assume various alternative variations and stage sequences, except where expressly specified to the contrary. It is also to be understood that the specific devices and processes illustrated in the attached drawings and described in the following specification are examples. Hence, specific dimensions and other physical characteristics related to the embodiments disclosed herein are not to be considered as limiting.

Unless otherwise indicated, all numbers expressing quantities of ingredients, reaction conditions, dimensions, physical characteristics, and so forth used in the specification and claims are to be understood as being modified in all instances by the term "about." Unless indicated to the contrary, the numerical parameters set forth in the following specification and attached claims are approximations that can vary depending upon the desired properties sought to be obtained by the present invention.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements.

Also, it should be understood that any numerical range recited herein is intended to include all sub-ranges subsumed therein. For example, a range of "1 to 10" is intended to include any and all sub-ranges between and including the recited minimum value of 1 and the recited maximum value of 10. That is, all subranges beginning with a minimum value equal to or greater than 1 and ending with a maximum value equal to or less than 10, and all subranges in between, e.g., 1 to 6.3, or 5.5 to 10, or 2.7 to 6.1.

The preceding examples and embodiments of the invention have been described with reference to various examples. Modifications and alterations will occur to others upon reading and understanding the foregoing examples. Accordingly, the foregoing examples are not to be construed as limiting the disclosure.

What is claimed is:

1. A hybrid inflatable park, comprising:

an inflatable park region comprising a plurality of inflatable attractions, wherein the inflatable park region comprises at least one inflatable chamber disposed between a play layer and a ground layer, the inflatable park region defining a well; and a framed play module comprising a footing forming part of a framed structure, wherein the footing extends into the well and wherein a skirt attaches the inflatable park region to a frame member of the footing and covers a gap in the well between the inflatable park region and the footing.

2. The hybrid inflatable park of claim 1, wherein the plurality of inflatable attractions comprises an inflatable module coupled with the framed play module by the skirt.

3. The hybrid inflatable park of claim 2, wherein the inflatable module extends into the framed play module.

4. The hybrid inflatable park of claim 2, wherein the inflatable module extends to an elevated platform of the framed play module, wherein the elevated platform is elevated from the play layer.

5. The hybrid inflatable park of claim 4, wherein a second skirt extends from an elevated portion of the inflatable module to the elevated platform.

6. The hybrid inflatable park of claim 1, wherein the frame member of the footing is a horizontal frame member.

7. The hybrid inflatable park of claim 1, wherein the skirt comprises a sandwich enclosure enclosing a flap.

8. The hybrid inflatable park of claim 7, wherein the sandwich enclosure comprises opposed sandwich flaps.

9. The hybrid inflatable park of claim 7, wherein an inward-facing fastener of the sandwich enclosure encloses an outward-facing fastener of the flap.

10. The hybrid inflatable park of claim 7, wherein one of the sandwich enclosure or the flap comprise a frame member anchor portion.

11. The hybrid inflatable park of claim 7, wherein one of the sandwich enclosure or the flap extends from the inflatable park region and wherein the other of the sandwich enclosure or the flap extends from a frame member of the framed structure.

12. The hybrid inflatable park of claim 1, wherein the plurality of inflatable attractions is formed as a plurality of interconnected inflatable modules.

13. The hybrid inflatable park of claim 12, wherein a first inflatable module defines a first portion of the well, wherein a second inflatable module defines a second portion of the well.

14. The hybrid inflatable park of claim 12, wherein the well is a first well and the footing is a first footing, wherein a first inflatable module defines the first well, wherein a second inflatable module defines a second well, wherein the first footing extends into the first well, and wherein a tower of the framed play module extends into the second well.

15. The hybrid inflatable park of claim 1, wherein the well extends through the play layer and the ground layer of the inflatable park region.

16. The hybrid inflatable park of claim 1, wherein the well is a recess within the inflatable park region.

17. The hybrid inflatable park of claim 16, wherein the recess is a blind recess.

18. The hybrid inflatable park of claim 1, wherein the well is an opening extending through the inflatable park region.

19. The hybrid inflatable park of claim 1, wherein a side panel connecting the play layer and the ground layer defines the well.

20. A hybrid inflatable park, comprising:

an inflatable park region comprising a plurality of inflatable attractions, wherein the inflatable park region comprises at least one inflatable chamber disposed between a play layer and a ground layer, the inflatable park region defining a plurality of wells; and a framed play module comprising a plurality of footings forming part of a framed structure, wherein each footing of the plurality of footings extends into one well of the plurality of wells, wherein, for each footing, a respective skirt attaches a frame member of the footing to the inflatable park region and covers a gap between the inflatable park region and the footing.

* * * * *